United States Patent [19]

Philipp et al.

[11] 4,437,370

[45] Mar. 20, 1984

[54] METHOD FOR THE OPERATION OF A CROSS-CUTTING APPARATUS

[75] Inventors: Helmut Philipp; Wilfried Kurth, both of Dusseldorf, Fed. Rep. of Germany

[73] Assignee: Jagenberg Werke AG, Dusseldorf, Fed. Rep. of Germany

[21] Appl. No.: 309,613

[22] Filed: Oct. 7, 1981

[30] Foreign Application Priority Data

Oct. 23, 1980 [DE] Fed. Rep. of Germany ..... 3039983

[51] Int. Cl.[3] ..... B26D 7/00

[52] U.S. Cl. ..... 83/23; 83/37; 83/289; 83/304; 83/364; 83/63

[58] Field of Search ..... 83/37, 38, 304, 305, 83/286–293, 364, 365, 303, 563, 564, 23–28, 63

[56] References Cited

U.S. PATENT DOCUMENTS

| | | | |
|---|---|---|---|
| 1,668,777 | 5/1928 | Martersteck | 83/305 |
| 1,939,588 | 12/1933 | Biggert, Jr. et al. | 83/76 |
| 4,265,152 | 5/1981 | Corradi | 83/303 |

*Primary Examiner*—James M. Meister

*Attorney, Agent, or Firm*—Sprung, Horn, Kramer & Woods

[57] ABSTRACT

In the cutting of a continuous web such as paper or cardboard into sheets employing a cross-cutting apparatus comprising conveyor rolls, a pair of parallel cross-knives and a sheet outfeeder, the improvement in the start-up or restarting of the apparatus which comprises moving the cross-knives to a position not interfering with the free passage of the web, starting the apparatus up by setting the conveyor rolls in rotation, and bringing the cross-knives into the cutting position only after the leading end of the web has been introduced in full web width into the sheet outfeeder.

3 Claims, 2 Drawing Figures

METHOD FOR THE OPERATION OF A CROSS-CUTTING APPARATUS

BACKGROUND

The invention relates to a method for the operation of a conveyor roller, one or more parallel sets of cross-knives and a cross-cutting apparatus comprising a sheet outfeeder, for paper or cardboard webs.

Conventional cross-cutting apparatus comprise revolving conveyor rollers for pulling a paper or cardboard web from a roll and feeding it to knives which cross-cut the web into sheets, and also to a sheet outfeeder.

Also known and commonly used are so-called duplex synchronous cross-cutters which have knife drums disposed parallel to one another in tandem and provided with knives which are offset from one another, for the purpose of cross-cutting parallel strips of paper produced by longitudinal slitting.

In different states of operation, such as start-up or restarting after a shutdown of the machine due to web breakage or the like, the cross-knives are in an indefinite position with respect to the leading end of the web. Consequently, when the cross-cutting apparatus is started up, the first cut produces an excessively short sheet. This short sheet then is left on the table disposed between the cross-knives and the entrance to the sheet gate, because it is not long enough to be caught by the belts of the outfeeder. This short sheet will sooner or later be nudged along by successive sheets and may thus accidently get into the finished stack, or it may cause jam-ups and consequently machine shut-downs. In the first case complaints will be made by the industry in which the printing screens can be damaged by the short sheets. In the second case, the machine shut-downs reduce the output of the plant.

THE INVENTION

It is the object of the invention to device a method of operation for the above-mentioned known cross-cutting apparatus for paper or cardboard webs, in which, upon the start-up or restarting of the apparatus, the first cut produces a sheet of a length that is at least as great as the prescribed sheet length, i.e., the assurance is provided that no short sheet will be formed which will not be grasped by the outfeed belts behind the cross-knives.

For the solution of this problem, it is proposed in accordance with the invention, in a process of the kind described above, that before the start-up or restarting of the apparatus the cross-knives be moved to a position in which they do not interfere with the free passage of the web, the apparatus is then started up by setting the conveyor rollers in rotation, but the cross-knives are moved into the cutting position only after the leading end of the web has been introduced into the sheet outfeeder over the full width of the web.

In other words, before the apparatus starts up or restarts, the cross-knives are moved to an inactive position. Only then are the conveyor rollers set in rotation and the web further transported. When the leading end of the web has been introduced on its full width into the sheet puller the cross-knives are activated to divide the web crosswise. The cut-off leading end of the web passes through the sheet outfeeder into the reject box.

The starting of the cross-knives can be controlled by means of photoelectric cells which are disposed at the entrance to the sheet outfeeder, detect the entry of the leading end of the web into the sheet outfeeder, and then give the signal for the operation of the cross-knives if they have detected the web over its entire width. The method of operation of a cross-cutting apparatus in accordance with the invention thus offers the advantage that, upon the start-up or restart, the first cut will certainly not produce a sheet that is shorter than the required length. The sheet first cut from the leading end of the web will instead be as long as the sheet next following, or else longer than that, so that the disadvantageous effects caused by a sheet cut too short are eliminated. The invention furthermore offers the advantage that it cannot happen that sheets will be cut to the prescribed length but will not have the correct shape because the leading end of the web was pointed.

The method of operation in accordance with the invention is basically also usable in cross-cutting apparatus which are equipped with cross-knives which move toward one another or away from one another. In modern high-speed cross-cutting apparatus, however, cross-knives applied to the circumference of revolving drums have become popular, the drums being arranged in pairs, one drum above and one drum below the web. The alignment of the cross-knife drums of a pair of drums with one another is such that the cutting edge on the upper drum cooperates with a cutting knife on the lower drum as a counter-knife in making the cut.

The method of operation proposed in accordance with the invention is suitable to special advantage for duplex cross-cutters, because in this case, on account of the offset arrangement of the knives for the cross-cutting of adjacent strips slit from the web, the production of excessively short sheets by the first cut after the start-up or restarting of the cross-cutting apparatus occurs more frequently.

In accordance with an advantageous development of the method of the invention, the cross-knives are to be brought into an inactive position when the roll has only a few layers of material left on it. This can again be detected by photoelectric cells or equivalent means. This additional measure will prevent the usually wet and wrinkled end of the web, when it snaps away from the core, from getting caught somewhere, tearing, and jamming the equipment. Cleaning up requires a great deal of time in which the apparatus is prevented from servicing for production purposes.

The method of operation in accordance with the invention will now be further explained in conjunction with the drawing, wherein.

Figure 1:
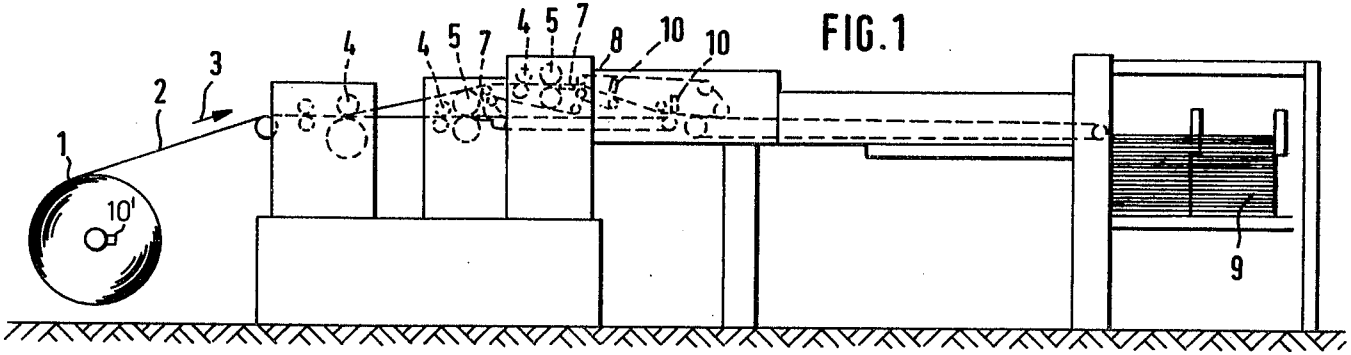
FIG. 1 shows a schematic side view of a cross-cutting apparatus.

From a roll 1, the web 2 is pulled in the direction of arrow 3 by the revolving feed rolls 4 which cooperate in pairs, and it is fed to the cross-knives 5 which sever the web 2 crosswise into sheets 6 which pass successively over the transfer table 7 to the outfeed belt sets 8 which advance them to the stack 9.

Photoelectric cells 10 are disposed at the entrance to the belt sets 8 and they start the operation of the cross-knives as soon as the leading end of the web is introduced into the outfeeder after start-up.

Figure 2:
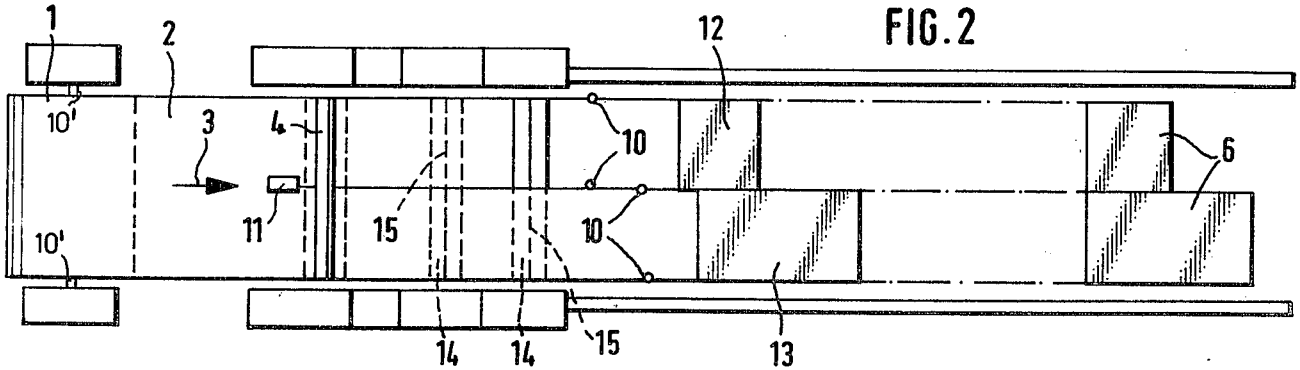
FIG. 2 is a top view of the apparatus in the form of a duplex cross-cutter.

In the duplex cross-cutter representted in FIG. 2, the web 2 slit lengthwise by the circular knife 11 into two strips 12 and 13 is divided crosswise by means of two cross-knives 15 disposed parallel to one another in tandem, and offset from one another.

At the entrance to the sheet outfeeder, photoelectric cells 10 are disposed for each strip 12 and 13, and they are coupled together in an OR circuit. The first cut will be performed by both of the knives 15 only when both photoelectric cells have detected the introduction of the strips 12 and 13 into the sheet outfeeder 8 over their full width. In an advantageous embodiment, the cross-knives 15 are to be brought into an inactive position when the roll 1 has only a few layers of material left on it. This can be detected by photoelectric cells 10'.

It will be appreciated that the instant specification and examples are set forth by way of illustration and not limitation, and that various modifications and changes may be made without departing from the spirit and scope of the present invention.

We claim:

1. In the cutting of a continuous web such as paper or cardboard into sheets employing a cross-cutting apparatus comprising conveyor rolls, a pair of parallel cross-knives and a sheet outfeeder, the improvement in the start-up or restarting of the apparatus which comprises moving the cross-knives to a position not interfering with the free passage of the web, starting the apparatus up by setting the conveyor rolls in rotation, and bringing the cross-knives into the cutting position only after the leading end of the web has been introduced in full web width into the sheet outfeeder.

2. A process according to claim 1, wherein the continuous web is fed from a roll and the cross-knives are brought to inactive position when the roll is wound with only a few remaining layers.

3. A process according to claim 1, wherein the web is longitudinally slit into web portions and parallel cross-knives are provided for cutting each web portion into sheets and wherein the cross-knives are brought into the cutting position only when the leading end of all of the web portions have been introduced in full web width into the sheet outfeeder.

* * * * *